US007219061B1

(12) United States Patent
Erdem et al.

(10) Patent No.: US 7,219,061 B1
(45) Date of Patent: May 15, 2007

(54) METHOD FOR DETECTING THE TIME SEQUENCES OF A FUNDAMENTAL FREQUENCY OF AN AUDIO RESPONSE UNIT TO BE SYNTHESIZED

(75) Inventors: Caglayan Erdem, Munich (DE); Martin Holzapfel, München (DE)

(73) Assignee: Siemens Aktiengesellschaft, Munich (DE)

( * ) Notice: Subject to any disclaimer, the term of this patent is extended or adjusted under 35 U.S.C. 154(b) by 963 days.

(21) Appl. No.: 10/111,695

(22) PCT Filed: Oct. 24, 2000

(86) PCT No.: PCT/DE00/03753

§ 371 (c)(1),
(2), (4) Date: Apr. 29, 2002

(87) PCT Pub. No.: WO01/31434

PCT Pub. Date: May 3, 2001

(30) Foreign Application Priority Data

Oct. 28, 1999 (DE) ..... 199 52 051

(51) Int. Cl.
*G10L 12/00* (2006.01)

(52) U.S. Cl. ..... 704/268; 704/211; 704/207; 704/209; 704/232; 704/259; 704/267

(58) Field of Classification Search ..... 704/268, 704/211, 207, 209, 202, 232, 259, 267
See application file for complete search history.

(56) References Cited

U.S. PATENT DOCUMENTS 5,668,926 A 9/1997 Karaali et al.
5,787,387 A * 7/1998 Aguilar ..... 704/208
5,913,194 A * 6/1999 Karaali et al. ..... 704/259
5,940,797 A * 8/1999 Abe ..... 704/260
6,078,885 A * 6/2000 Beutnagel ..... 704/258
6,366,884 B1 * 4/2002 Bellegarda et al. ..... 704/266
6,665,641 B1 * 12/2003 Coorman et al. ..... 704/260
2002/0194002 A1 * 12/2002 Petrushin ..... 704/270

FOREIGN PATENT DOCUMENTS

GB 2325599 A 11/1998

OTHER PUBLICATIONS

Huang et al., "Recent Improvements on Microsoft's Trainable Text-To-Speech System—Whistler", IEEE, 1997, pp. 959-962.

Haury et al., "Optimization of a Neural Network for Speaker and Task Dependent $F_0$- Generation", IEEE, 1998, pp. 297-300.

* cited by examiner

*Primary Examiner*—David Hudspeth
*Assistant Examiner*—Jakieda R. Jackson
(74) *Attorney, Agent, or Firm*—Staas & Halsey LLP

(57) ABSTRACT

Predetermined macrosegments of the fundamental frequency are determined by a neural network, and these predefined macrosegments are reproduced by fundamental-frequency sequences stored in a database. The fundamental frequency is generated on the basis of a relatively large text section which is analyzed by the neural network. Microstructures from the database are received in the fundamental frequency. The fundamental frequency thus formed is thus optimized both with regard to its macrostructure and to its microstructure. As a result, an extremely natural sound is achieved.

24 Claims, 3 Drawing Sheets

METHOD FOR DETECTING THE TIME SEQUENCES OF A FUNDAMENTAL FREQUENCY OF AN AUDIO RESPONSE UNIT TO BE SYNTHESIZED

CROSS REFERENCE TO RELATED APPLICATIONS

This application is based on and hereby claims priority to PCT Application No. PCT/DE00/03753 filed on Oct. 24, 2000 and German Application No. 199 52 051.8 filed on Oct. 28, 1999, the contents of which are hereby incorporated by reference.

BACKGROUND OF THE INVENTION

The invention relates to a method for determining the time characteristic of a fundamental frequency of a voice response to be synthesized.

At the ICASSP 97 conference in Munich, a method for synthesizing voice from a text, which is completely trainable and assembles and generates the prosody of a text by prosody patterns stored in a database, was presented under the title "Recent Improvements on Microsoft's Trainable Text-to-Speech System Whistler", X. Huang et al. The prosody of a text is essentially defined by the fundamental frequency which is why this known method can also be considered as a method for generating a fundamental frequency on the basis of corresponding patterns stored in a database. To achieve a type of speech which is as natural as possible, elaborate correction methods are provided which interpolate, smooth and correct the contour of the fundamental frequency.

At the ICASSP 98 in Seattle, a further method for generating a synthetic voice response from a text was presented under the title "Optimization of a Neural Network for Speaker and Task Dependent $F_0$ Generation", Ralf Haury et al. To generate the fundamental frequency, this known method uses, instead of a database with patterns, a neural network by which the time characteristic of the fundamental frequency for the voice response is defined.

The methods described above are to be used for creating a voice response which does not have a metallic, mechanical and unnatural sound as is known from conventional speech synthesis systems. These methods represent a distinct improvement compared with the conventional speech synthesis systems. Nevertheless, there are considerable tonal differences between the voice response based on this method and a human voice.

In a speech synthesis in which the fundamental frequency is composed of individual fundamental-frequency patterns, in particular, a metallic, mechanical sound is still generated which can be clearly distinguished from a natural voice. If, in contrast, the fundamental frequency is defined by a neural network, the voice is more natural but it is somewhat dull.

One aspect of the invention is, therefore, based on the object of creating a method for determining the time characteristic of a fundamental frequency of a voice response to be synthesized which imparts a natural sound to the voice response which is very similar to a human voice.

SUMMARY OF THE INVENTION

The method according to one aspect of the invention for determining the time characteristic of a fundamental frequency of a voice response to be synthesized comprising the following steps:

determining predefined macrosegments of the fundamental frequency by a neural network, and determining microsegments by fundamental-frequency sequences stored in a database, the fundamental-frequency sequences being selected from the database in such a manner that the respective predefined macrosegment is reproduced with the least possible deviation by the successive fundamental-frequency sequences.

One aspect of the present invention is based on the finding that the determination of the characteristic of a fundamental frequency by a neural network generates the macrostructure of the time characteristic of a fundamental frequency very similarly to the characteristic of the fundamental frequency of a natural voice, and the fundamental-frequency sequences stored in a database very similarly reproduce the microstructure of the fundamental frequency of a natural voice. The combination according to one aspect of the invention thus achieves an optimum determination of the characteristic of the fundamental frequency which is much more similar to that of the natural voice, both in the macrostructure and in the microstructure, than in the case of a fundamental frequency generated by the previously known methods. This results in a considerable approximation of the synthetic voice response to a natural voice. The resultant synthetic voice is very similar to the natural voice and can hardly be distinguished from the latter.

The deviation between the reproduced macrosegment and the predefined macrosegment is preferably determined by a cost function which is weighted in such a manner that in the case of small deviations from the fundamental frequency of the predefined macrosegment, only a small deviation is determined and when predetermined limit frequency differences are exceeded, the deviations determined rise steeply until a saturation value is reached. This means that all fundamental-frequency sequences which are located within the range of the limit frequencies represent a meaningful selection for reproducing the predefined macrosegment and the fundamental-frequency sequences located outside the range of the limit-frequency differences are assessed as being considerably more unsuitable for reproducing the predefined macrosegment.

This nonlinearity reproduces the nonlinear behavior of human hearing.

According to a further preferred embodiment of one aspect of the invention, the closer any deviations are to the edge of a syllable, the less weighting is given them.

The predefined macrosegment is preferably reproduced by generating a number of fundamental-frequency sequences for in each case one microprosodic unit, combinations of fundamental-frequency sequences being assessed both with regard to the deviation from the predefined macrosegment and with respect to a syntonization in pairs. A combination of fundamental-frequency sequences is then correspondingly selected in dependence on the result of these two assessments (deviation from the predefined macrosegment, syntonization between adjacent fundamental-frequency sequences).

This syntonization in pairs is used for assessing, in particular, the transitions between adjacent fundamental-frequency sequences and relatively large discontinuities should be avoided. According to a preferred embodiment of one aspect of the invention, these syntonizations in pairs of the fundamental-frequency sequences are given greater weighting within a syllable than in the edge carrier of the syllable. In German, the syllable core is decisive for what is heard.

BRIEF DESCRIPTION OF THE DRAWINGS

These and other objects and advantages of the present invention will become more apparent and more readily appreciated from the following description of the preferred embodiments, taken in conjunction with the accompanying drawings of which.

DETAILED DESCRIPTION OF THE PREFERRED EMBODIMENT

Figure 1A:
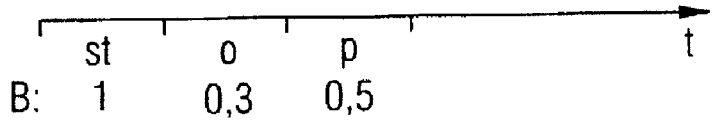
FIGS. 1*a* to 1*d* diagrammatically show the structure and the assembling of the time characteristic of a fundamental frequency in four steps, FIG. 2 diagrammatically shows a function for weighting a cost function for determining the deviation between a reproduced macrosegment and a predefined macrosegment.

Reference will now be made in detail to the preferred embodiments of the present invention, examples of which are illustrated in the accompanying drawings, wherein like reference numerals refer to like elements throughout.

Figure 6:
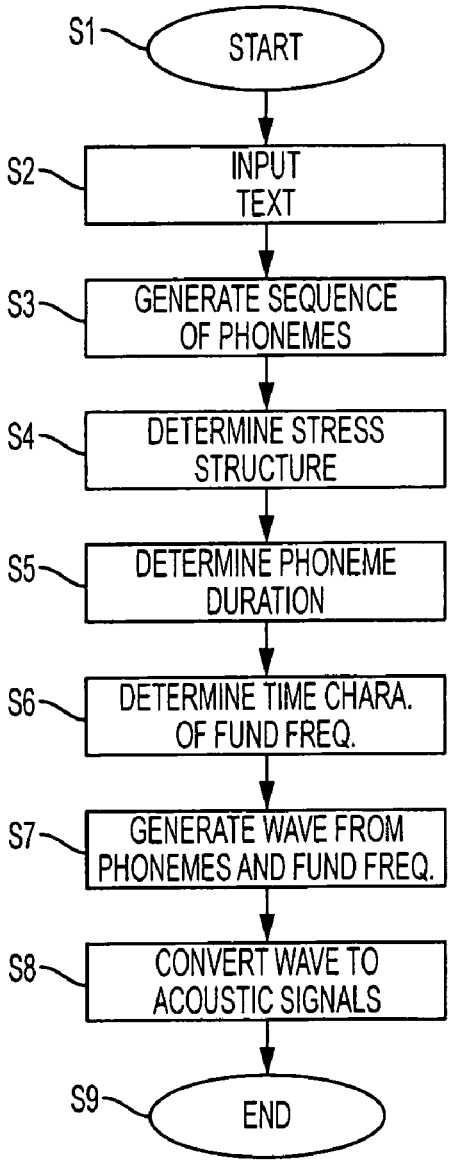

In FIG. 6, a method for synthesizing speech in which a text is converted into a sequence of acoustic signals is shown in a flowchart.

This method is implemented in the form of a computer program which is started by step S1.

In step S2, a text is input which is present in the form of an electronically readable text file.

In the subsequent step S3, a sequence of phonemes, that is to say a sequence of sounds, is generated in which the individual graphemes of the text, that is to say in each case individual or several letters to which in each case one phoneme is allocated, are determined. The phonemes allocated to the individual graphemes are then determined, which defines the sequence of phonemes.

In step S4, a stressing structure is determined, that is to say it is determined how much the individual phonemes are to be stressed.

The stressing structure is represented by the word "stop" on a time axis in FIG. 1*a*. Accordingly, stress level 1 has been allocated to the grapheme "st", stress level 0.3 has been allocated to the grapheme "o" and stress level 0.5 has been allocated to the grapheme "p".

After that, the duration of the individual phonemes is determined (S5).

In step S6, the time characteristic of the fundamental frequency is determined which is discussed in greater detail below.

Once the phoneme sequence and the fundamental frequency have been defined, a wave file can be generated on the basis of the phonemes and of the fundamental frequency (S7).

The wave file is converted into acoustic signals by an acoustic output unit and a loudspeaker (S8) which ends the voice response (S9).

According to one aspect of the invention, the time characteristic of the fundamental frequency of the voice response to be synthesized is generated by a neural network in combination with fundamental-frequency sequences stored in a database.

Figure 5:
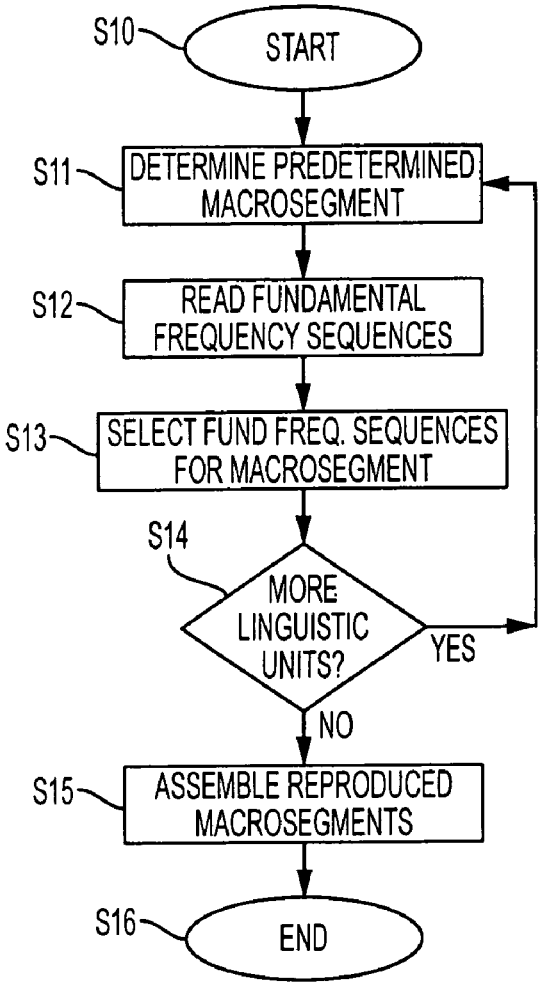

The method corresponding to step S6 from FIG. 6 is shown in greater detail in a flowchart in FIG. 5.

This method for determining the time characteristic of the fundamental frequency is a subroutine of the program shown in FIG. 6. The subroutine is started by step S10.

Figure 4:
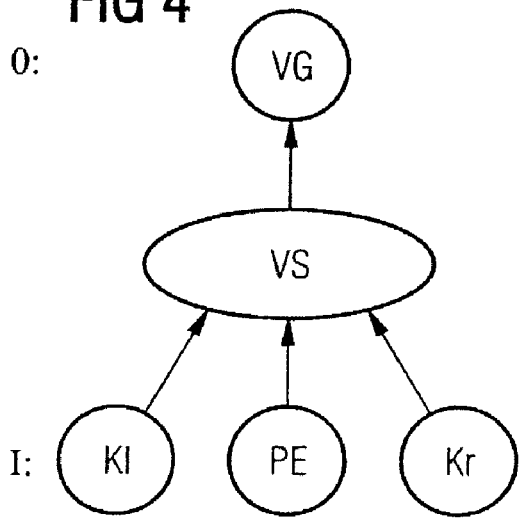

In step S11, a predefined macrosegment of the fundamental frequency is determined by a neural network. Such a neural network is shown diagrammatically simplified in FIG. 4. At an input layer 1, the neural network has nodes for inputting a phonetic linguistic unit PE of the text to be synthesized and a context Kl, Kr to the left and to the right of the phonetic linguistic unit. The phonetic linguistic unit may be, e.g. a phrase, a word or a syllable of the text to be synthesized for which the predefined macrosegment of the fundamental frequency is to be determined. The left-hand context Kl and the right-hand context Kr in each case represent a text section to the left and to the right of the phonetic linguistic unit PE. The data input with the phonetic unit comprise the corresponding phoneme sequence, stress structure and sound duration of the individual phonemes. The information input with the left-hand and right-hand context, respectively, comprises at least the phoneme sequence and it may be appropriate also to input the stress structure and/or the sound duration. The length of the left-hand and right-hand context can correspond to the length of the phonetic linguistic unit PE, that is to say can again be a phrase, a word or a syllable. However, it may also be appropriate to provide a longer context of, e.g. two or three words as the left-hand or right-hand context. These inputs Kl, PE and Kr are processed in a hidden layer VS and output as predefined macrosegment VG of the fundamental frequency at an output layer O.

Figure 1B:
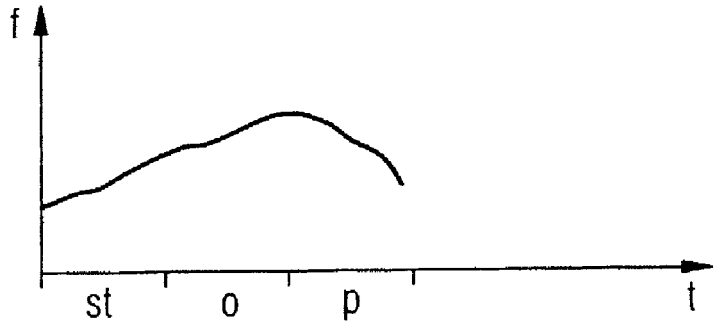

Such a predefined macrosegment for the word "stop" is shown in FIG. 1*b*. This predefined macrosegment has a typical triangular characteristic which initially begins with a rise and ends with a slightly shorter fall.

After the determination of a predefined macrosegment of the fundamental frequency, the microsegments corresponding to the predefined macrosegment are determined in steps S12 and S13.

Figure 1C:
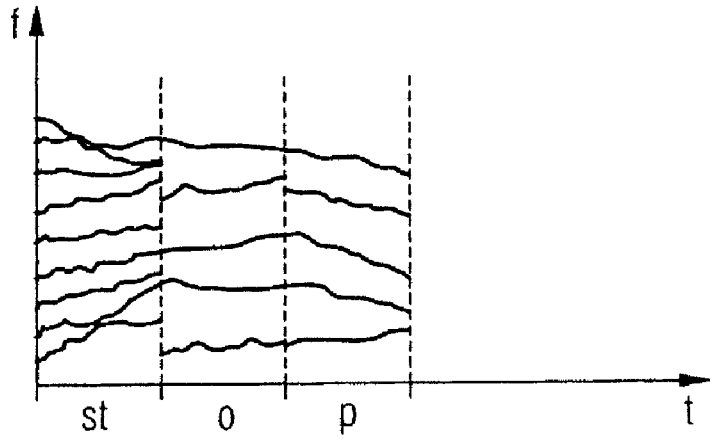

In step S12, lacuna are read out of a database in which fundamental-frequency sequences allocated to graphemes are stored, there being a multiplicity of fundamental-frequency sequences for each grapheme, as a rule. Such fundamental-frequency sequences for the graphemes "st", "o" and "p" are shown diagrammatically in FIG. 1*c*, only a small number of fundamental-frequency sequences being shown to simplify the drawing.

In principle, these fundamental-frequency sequences can be combined with one another arbitrarily. The possible combinations of these fundamental-frequency sequences are assessed by a cost function. This method step is carried out by the Viterbi algorithm.

For each combination of fundamental-frequency sequences which has a fundamental-frequency sequence for each phoneme, a cost factor Kf is calculated by the following cost function:

$$Kf = \sum_{j=1}^{j=1} lok(f_{ij}) + Verk(f_{ij}, F_{n,j+1})$$

The cost function is a sum of j=1 to l, where j is the enumerator of the phonemes and l is the total number of all phonemes. The cost function has two terms, a local cost function lok (kij) and a combination cost function Ver (kij, kn, j+1). The local cost function is used for assessing the deviation of the ith fundamental-frequency sequence of the jth phoneme from the predefined macrosegment. The combination cost function is used for assessing the syntonization between the ith fundamental frequency of the jth phoneme with the nth fundamental-frequency sequence of the j+1th phoneme.

The local cost function has the following form, for example:

$$lok(f_{ij}) = \int_{ta}^{te} (f_V(t) - f_{ij}(t))^2 \, dt$$

The local cost function is thus an integral over the time range of the beginning ta of a phoneme to the end te of the phoneme over the square of the difference of the fundamental frequency $f_v$ predetermined by the predefined macrosegment and the ith fundamental-frequency sequence of the jth phoneme.

This local cost function thus determines a positive value of the deviation between the respective fundamental-frequency sequence and the fundamental frequency of the predefined macrosegment. In addition, this cost function can be implemented very simply and, due to its parabolic characteristic, generates a weighting which resembles that of human hearing since relatively small deviations around the predefined sequence $f_v$ are given little weighting whereas relatively large deviations are progressively weighted.

Figure 2:
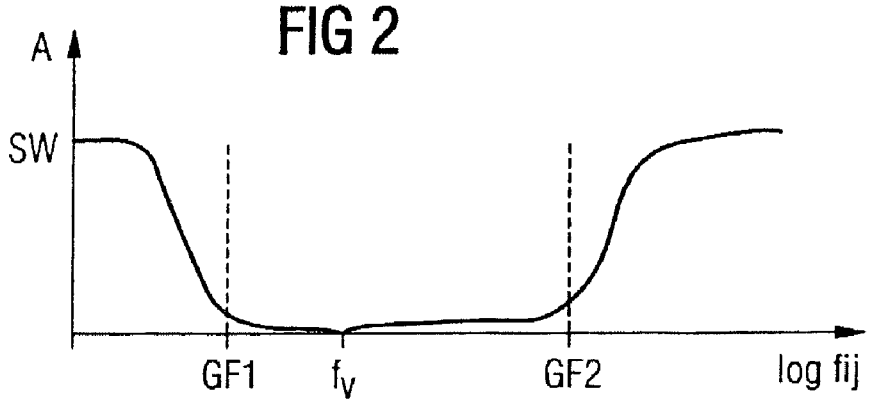

According to a preferred embodiment, the local cost function is provided with a weighting term which leads to the functional characteristic shown in FIG. 2. The diagram of FIG. 2 shows the value of the local cost function lok ($f_{ij}$) in dependence on the logarithm of the frequency $f_{ij}$ of the ith fundamental-frequency sequence of the jth phoneme. The diagram shows that deviations from the predefined frequency $f_v$ within certain limit frequencies GF1, GF2 are only given little weighting whereas a wider deviation produces a steeply increasing rise up to a threshold value SW. Such weighting corresponds to human hearing which scarcely perceives small frequency deviations but registers a distinct difference above certain frequency differences.

The combination cost function is used for assessing how well two successive fundamental-frequency sequences are syntonized with one another. In particular, the frequency difference at the junction of the two fundamental-frequency sequences is assessed and, the greater the difference at the end of the preceding fundamental-frequency sequence from the frequency at the beginning of the subsequent fundamental-frequency sequences, the greater the output value of the combination cost function. In this process, however, other parameters can also be taken into consideration which reproduce, e.g. the steadiness of the transition or the like.

In a preferred embodiment of the invention, the closer the respective junction of two adjacent fundamental-frequency sequences is arranged to the edge of a syllable, the less weighting is given to the output value of the combination cost function. This corresponds to human hearing which analyzes acoustic signals at the edge of a syllable less intensively than in the center area of the syllable. Such weighting is also called perceptively dominant.

According to the above cost function Kf, the values of the local cost function and of the combination cost function of all fundamental-frequency sequences are determined and added together for each combination of fundamental-frequency sequences of the phonemes of a linguistic unit for which a predefined macrosegment has been determined. From the set of combinations of the fundamental-frequency sequences, the combination for which the cost function Kf has produced the smallest value is selected since this combination of fundamental-frequency sequences forms a fundamental-frequency characteristic for the corresponding linguistic unit which is called the reproduced macrosegment and is very similar to the predefined macrosegment.

Using the method according to one aspect of the invention, fundamental-frequency characteristics matched to the predefined macrosegments of the fundamental frequency generated by the neural network are generated by individual fundamental-frequency sequences stored in a database. This ensures a very natural macrostructure which, in addition, also has the microstructure of the fundamental-frequency sequences in every detail.

Figure 1D:
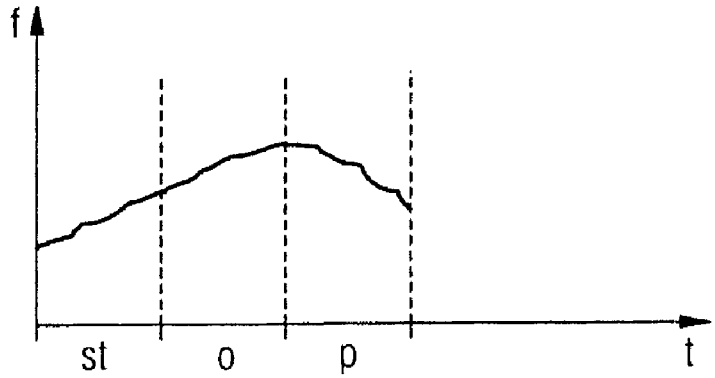

Such a reproduced macrosegment for the word "stop" is shown in FIG. 1*d*.

Once the selection of combinations of fundamental-frequency sequences for reproducing the predefined macrosegment is concluded in step S13, a check is made in step S14 whether a further time characteristic of the fundamental frequency has to be generated for a further phonetic linguistic unit. If this interrogation in step S14 provides a "yes", the program sequence jumps back to step S11 and if not, the program sequence branches to step S15 in which the individual reproduced macrosegments of the fundamental frequency are assembled.

Figure 3:
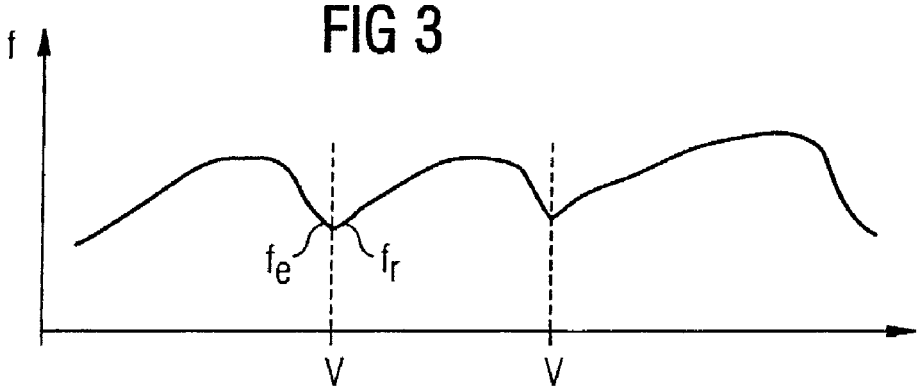
FIG. 3 shows the characteristic of a fundamental frequency having a number of macrosegments, FIG. 4 diagrammatically shows the simplified structure of a neural network, FIG. 5 diagrammatically shows the method according to an embodiment of the invention in a flowchart, and FIG. 6 diagrammatically shows a method for synthesizing speech which is based on the method according to an embodiment of the invention.

In step S15, the junctions between the individual reproduced macrosegments are aligned with one another as is shown in FIG. 3. In this process, the frequencies to the left $f_l$ and to the right $f_r$ of the junctions V are matched to one another and the end areas of the reproduced macrosegments are preferably changed in such a way that the frequencies $f_l$ and $f_r$ have the same value. The transition in the area of the junction can preferably also be smoothed and/or made steady.

Once the reproduced macrosegments of the fundamental frequency have been generated and assembled for all linguistic phonetic units of the text, the subroutine is terminated and the program sequence returns to the main program (S16).

The method according to one aspect of the invention can thus be used for generating a characteristic of a fundamental frequency which is very similar to the fundamental frequency of a natural voice since relatively large context ranges can be covered and evaluated in a simple manner by the neural network (macrostructure) and, at the same time, very fine structures of the fundamental-frequency characteristic corresponding to the natural voice can be generated by the fundamental-frequency sequences stored in the database (microstructure). This provides for a voice response with a much more natural sound than in the previously known methods.

The invention has been described in detail with particular reference to preferred embodiments thereof and examples, but it will be understood that variations and modifications can be effected within the spirit and scope of the invention. Thus, for example, the order of when the fundamental-frequency sequences are taken from the database and when the neural network generates the predefined macrosegment can be varied. For example, it is also possible that initially predefined macrosegments are generated for all phonetic linguistic units and only then the individual fundamental-frequency sequences are read out, combined, weighted and selected. In the context of the invention, the most varied cost functions can also be used as long as they take into consideration a deviation between a predefined macrosegment of the fundamental frequency and microsegments of the fundamental frequencies. The integral of the local cost function described above can also be represented as a sum for numeric reasons.

The invention claimed is:

1. A method for determining the time characteristic of a fundamental frequency of speech to be synthesized, comprising:

determining macrosegments of the fundamental frequency by a neural network, each macrosegment comprising a time sequence of the fundamental frequency of a phonetic linguistic unit of the speech, and selecting microsegments to reproduce each macrosegment by selecting fundamental-frequency sequences from a plurality of fundamental-frequency sequences stored in a database, each microsegment comprising a time sequence of the fundamental frequency of a subunit of the phonetic linguistic unit of the speech, the fundamental-frequency sequences being selected from the database in such a manner that each macrosegment is reproduced with the least possible deviation between successive microsegments.

2. The method as claimed in claim 1, wherein the phonetic linguistic unit is selected from the group consisting of a phrase, a word, and a syllable.

3. The method as claimed in claim 2, wherein the fundamental-frequency sequences of the microsegments represent the fundamental frequencies of in each case one phoneme.

4. The method as claimed in claim 3, wherein the fundamental-frequency sequences of the microsegments which are located within a time range of one of the macrosegments are assembled to form one reproduced macrosegment, the deviation of the reproduced macrosegment from the respective macrosegment being determined and the fundamental-frequency sequences being optimized in such a manner that the deviation is as small as possible.

5. The method as claimed in claim 4, wherein in each case a number of fundamental-frequency sequences can be selected for the individual microsegments, where the combinations of fundamental-frequency sequences resulting in the least deviation between the respective reproduced macrosegment and the respective macrosegment are selected.

6. The method as claimed in claim 5, wherein the deviation between the reproduced macrosegment and the macrosegment is determined by a cost function which is weighted in such a manner that in the case of small deviations from the fundamental frequency of the macrosegment, only a small deviation is determined and when a predetermined limit frequency difference is exceeded, the deviations determined rise steeply until a saturation value is reached.

7. The method as claimed in claim 6, wherein the deviation between the reproduced macrosegment and the macrosegment is determined by a cost function by which a multiplicity of deviations distributed over the macrosegments are weighted, and the closer the deviations are to the edge of a syllable, the less weighting is applied to them.

8. The method as claimed claim 7, wherein during the selecting of the fundamental-frequency sequences, the individual fundamental-frequency sequences are syntonized with the following or preceding fundamental-frequency sequences in accordance with predetermined criteria and only combinations of fundamental-frequency sequences meeting the criteria of being admitted to be assembled to form a reproduced macrosegment.

9. The method as claimed in claim 8, wherein adjacent fundamental-frequency sequences are assessed by means of a cost function which generates an output value, to be minimized, for a junction between fundamental-frequency sequences, and the greater the difference at the end of the preceding fundamental-frequency sequence from the frequency at the beginning of the subsequent fundamental-frequency sequence, the greater the output value.

10. The method as claimed in claim 9, wherein the closer the a junction is to an edge of a syllable, the less weighting is applied to the output value.

11. The method as claimed in claim 10, wherein the macrosegments are concatenated with one another and the fundamental frequencies are matched to one another at the junctions of the macrosegments.

12. The method as claimed in claim 11, wherein the neural network determines the macrosegments for a predetermined section of a text on the basis of this text section and of a text section preceding and/or following this text section.

13. The method as claimed in claim 1, wherein the fundamental-frequency sequences of the microsegments represent the fundamental frequencies of in each case one phoneme.

14. The method as claimed in claim 1, wherein the fundamental-frequency sequences of the microsegments which are located within a time range of one of the macrosegments are assembled to form one reproduced macrosegment, the deviation of the reproduced macrosegment from the respective macrosegment being determined and the fundamental-frequency sequences being optimized in such a manner that the deviation is as small as possible.

15. The method as claimed in claim 14, wherein in each case a number of fundamental-frequency sequences can be selected for the individual microsegments, where the combinations of fundamental-frequency sequences resulting in the least deviation between the respective reproduced macrosegment and the respective macrosegment are selected.

16. The method as claimed in claim 15, wherein the deviation between the reproduced macrosegment and the macrosegment is determined by a cost function which is weighted in such a manner that in the case of small deviations from the fundamental frequency of the macrosegment, only a small deviation is determined and when a predetermined limit frequency difference is exceeded, the deviations determined rise steeply until a saturation value is reached.

17. The method as claimed in claim 15, wherein the deviation between the reproduced macrosegment and the macrosegment is determined by a cost function by which a multiplicity of deviations distributed over the macrosegments are weighted, and the closer the deviations are to the edge of a syllable, the less weighting is applied to them.

18. The method as claimed claim 15, wherein during the selecting of the fundamental-frequency sequences, the individual fundamental-frequency sequences are synchronized with the following or preceding fundamental-frequency sequences in accordance with predetermined criteria and only combinations of fundamental-frequency sequences meeting the criteria of being admitted to be assembled to form a reproduced macrosegment.

19. The method as claimed in claim 18, wherein adjacent fundamental-frequency sequences are assessed by means of a cost function which generates an output value, to be minimized, for a junction between fundamental-frequency sequences, and the greater the difference at the end of the preceding fundamental-frequency sequence from the frequency at the beginning of the subsequent fundamental-frequency sequence, the greater the output value.

20. The method as claimed in claim 19, wherein the closer the a junction is to an edge of a syllable, the less weighting is applied to the output value.

21. The method as claimed in claim 1, wherein the macrosegments are concatenated with one another and the fundamental frequencies are matched to one another at the junctions of the macrosegments.

22. The method as claimed in claim 1, wherein the neural network determines the macrosegments for a predetermined section of a text on the basis of this text section and of a text section preceding and/or following this text section.

23. A method for synthesizing speech in which a text is converted to a sequence of acoustic signals, comprising converting the text into a sequence of phonemes, generating a stressing structure, determining the duration of the individual phonemes, determining the time characteristic of a fundamental frequency by a method comprising:

determining macrosegments of the fundamental frequency by a neural network, each macrosegment comprising a time sequence of the fundamental frequency of a phonetic linguistic unit of the speech, and selecting microsegments to reproduce each macrosegment by selecting fundamental-frequency sequences from a plurality of fundamental-frequency sequences stored in a database, each microsegment comprising a time sequence of the fundamental frequency of a subunit of the phonetic linguistic unit of the speech, the fundamental-frequency sequences being selected from the database in such a manner that each macrosegment is reproduced with the least possible deviation between successive microsegments, and generating the acoustic signals representing the speech on the basis of the sequence of phonemes determined and of the fundamental frequency determined.

24. A method for reproducing a speech synthesis macrosegment, comprising:

using a neural network, selecting microsegments by selecting a fundamental-frequency sequences from a plurality of fundamental frequency sequences stored in a database, each microsegment comprising a time sequence at the fundamental frequency of a subunit of the phonetic linguistic unit of the speech, the fundamental-frequency sequences being selected from the database to minimize deviations between successive microsegments; and assembling the microsegments with the selected fundamental-frequency sequences and thereby reproducing the macrosegment each macrosegment comprising a time sequence at the fundamental frequency of a phonetic linguistic unit of the speech.

* * * * *